US006607379B2

(12) United States Patent
Isobe et al.

(10) Patent No.: US 6,607,379 B2
(45) Date of Patent: Aug. 19, 2003

(54) TEMPERATURE CONTROL METHOD IN HOT PRESSING

(75) Inventors: Kokichi Isobe, Aichi-ken (JP); Kazuhisa Wanibe, Aichi-ken (JP)

(73) Assignee: Kabushiki Kaisha Meiki Seisakusho, Aichi-ken (JP)

( * ) Notice: Subject to any disclaimer, the term of this patent is extended or adjusted under 35 U.S.C. 154(b) by 0 days.

(21) Appl. No.: 10/288,569

(22) Filed: Nov. 6, 2002

(65) Prior Publication Data

US 2003/0094739 A1 May 22, 2003

(30) Foreign Application Priority Data

Nov. 20, 2001 (JP) ..... 2001-354004

(51) Int. Cl.[7] ..... B30B 15/34

(52) U.S. Cl. ..... 432/36; 100/38; 100/319; 100/323

(58) Field of Search ..... 432/36, 49; 100/38, 100/92, 319, 322, 323, 295

(56) References Cited

U.S. PATENT DOCUMENTS 2,974,751 A * 3/1961 Norton ..... 187/319
3,594,867 A * 7/1971 Pfeiffer ..... 425/143
4,140,050 A * 2/1979 Giddings ..... 100/38
4,304,178 A * 12/1981 Haberle ..... 100/323
4,365,547 A * 12/1982 McClure, Jr. ..... 100/38
4,937,024 A * 6/1990 Hickson ..... 264/83
5,297,480 A * 3/1994 Miyashita et al. ..... 100/90
5,468,315 A * 11/1995 Okada et al. ..... 156/64

OTHER PUBLICATIONS

Patent Abstracts of Japan, "Hot Plate Temperature Control Apparatus in Hot Press," Ogawa Akihiko, Application No. 01–339852, Publication No. 03–197044, Aug. 28, 1991.

* cited by examiner

*Primary Examiner*—Gregory Wilson
(74) *Attorney, Agent, or Firm*—Browdy and Neimark, P.L.L.C.

(57) ABSTRACT

In a known control method, a large deviation between the temperature of a heating plate and a temperature-setting pattern occurs, and an overshoot or undershoot occurs. Therefore, a workpiece is unstably formed, the number of defective parts is increased and the productivity is decreased. Any two temperatures from among the temperature of the heating medium in the inlet manifold 5 that distributes and supplies the heating medium to each heating plate, the temperature of the heating medium in the outlet manifold 8 that collects the heating medium discharged from the heating plates 4 and the temperature of the heating plates 4, are detected. Then, a temperature value is obtained by selecting any one of the two temperatures based on a temperature-setting pattern 16, or is obtained by obtaining a weighted average of at least two temperatures from among the three temperatures based on preset weights. The temperature value is feedback-controlled so as to be identical to the temperature-setting pattern 16 of the heating plate 4.

5 Claims, 2 Drawing Sheets

| | Steps | Temperature setting range | Weight of temperature | | | Control constant | | |
|---|---|---|---|---|---|---|---|---|
| | | | Inlet manifold (%) | Heating plate (%) | Outlet manifold (%) | P (%) | I (sec.) | D (sec.) |
| Temperature setting pattern | Temperature increasing | 0-110℃ | 10 | 20 | 70 | 5 | 50 | 20 |
| | | 240℃ | 10 | 30 | 60 | 4 | 50 | 20 |
| | | 360℃ | 10 | 40 | 50 | 3 | 50 | 20 |
| | Maintaining | 0-120℃ | 10 | 50 | 40 | 5 | 50 | 20 |
| | | 240℃ | 10 | 60 | 30 | 4 | 50 | 20 |
| | | 360℃ | 10 | 70 | 20 | 3 | 50 | 20 |
| | Cooling | 0-130℃ | 0 | 100 | 0 | 3 | 50 | 20 |
| | | 240℃ | 10 | 50 | 40 | 4 | 50 | 20 |
| | | 360℃ | 10 | 20 | 70 | 5 | 50 | 20 |

FIG. 2

TEMPERATURE CONTROL METHOD IN HOT PRESSING

BACKGROUND OF THE INVENTION

1. Field of the Invention

The present invention relates to a temperature control method in hot pressing, in which the temperature of a heating plate is controlled by use of a heating medium such as vapor, hot oil or water.

2. Description of the Related Art

A hot pressing apparatus in which a temperature control method according to the present invention is carried out is generally indicated at 1 in FIG. 1. The structure of the apparatus shown in FIG. 1 is identical to a hot pressing apparatus for a conventional temperature control method. In the hot pressing apparatus 1, a plurality of heating plates 4 that are equally spaced are arranged between a movable platen 3 and a stationary platen 2 when the movable platen 3 is most distant from the stationary platen 2. Workpieces are placed on the heating plates 4 and, then, the movable platen 3 is moved close to and pressed against the stationary platen 2 by a pressing device (not shown) to form the workpiece. At this time, a heating medium whose pressure or flow rate is controlled by a control valve 23, is supplied from a heating medium source 24 through an inlet manifold 5 to heat or cool each heating plate 4 and, thereafter, is collected by an outlet manifold 8 and is returned to the heating medium source 24. In a heating-plate-temperature control of the conventional hot pressing apparatus, temperature or pressure sensors are provided at the inlet manifold 5, the outlet manifold 8 or the heating plates 4. The control valve 23 is controlled by a feedback-control, only based on detection values of a sensor 6, a sensor 9 or sensors 11 to 14.

In the conventional control method, the control can be stably carried out in a temperature-setting pattern (maintaining step 18) in which the temperature is constant in the lapse of time, because there is no deviation between a preset value and a measured value. However, there is a deviation between a preset value and a measured value in a temperature-setting pattern, such as a temperature increasing step 17 or a cooling step 19, in which the temperature varies in accordance with the lapse of time. Especially, if variations in temperature, i.e., the temperature gradient in the temperature-setting pattern is large, the measured value varies, with a delay, with respect to the preset value and an overshoot or undershoot of the measured value occurs at the transfer point between the temperature increasing step 17 or the cooling step 19 and the maintaining step 18.

The reasons that such a phenomenon occurs are as follows. Namely, if the heating medium is hot oil or water, the heat exchange is enhanced as the flow rate of the heating medium is increased and, thus the control accuracy of temperature is improved. However, it is impractical to remarkably increase the flow rate, in terms of cost performance because a large and expensive pump is required to increase the flow rate of the heating medium. Large diameter pipes and the inlet manifold 5, etc., are provided in a heating medium passage between the control valve 23 and the heating plates 4 and, thus the control is retarded by a time corresponding to passing of the heating medium remaining in the pipes and the inlet manifold 5 through the heating plates 4.

The above problem is more serious when the sensor is located at the outlet manifold 8. To solve this problem, the sensor can be provided at the inlet manifold 5, instead of at the outlet manifold. However, in this solution, another problem arises. Namely, the control is carried out so that the temperature of the heating medium before entering the heating plates 4 is equal to a preset value. Therefore, the temperature of the heating plates varies in accordance with a change in heat capacity due to a difference in the size or material of workpieces. In addition, even if the size or material of the workpieces are the same, when workpieces are not placed on all the heating plates, the heat capacity decreases in accordance with the amount of decrease of the workpiece and, then the temperature of the heating plate tends to increase.

In recent years, a rapid cooling speed that had not been previously required has been needed in forming of the workpieces. If such rapid cooling is controlled by feedback based on the temperature of the heating medium only, the control is carried out indirectly, thus leading to an inevitable delay in control. To avoid this problem, the cooling can be directly controlled by feedback of the temperature of the heating plate. However, in such a heating medium control system, it is very difficult to stably control all the steps.

SUMMARY OF THE INVENTION

According to the present invention, any two temperatures from among a temperature of the heating medium in an inlet manifold that distributes and supplies the heating medium to each heating plate, a temperature of the heating medium in an outlet manifold that collects the heating medium discharged from the heating plates and a temperature of the heating plates, are detected; the two temperatures are selected in accordance with a temperature-setting pattern; and feedback-control is carried out so that the selected temperature matches the temperature-setting pattern. With this structure, a control loop having an optimum temperature-detecting portion suitable for steps to be controlled can be constructed, and a precise temperature control can be carried out in each step.

BRIEF DESCRIPTION OF THE DRAWINGS

FIG. 2 shows a setting screen of a control device for setting a weight and a PID constant of each sensor in a heating medium temperature control loop for controlling the temperature of the heating plates.

DESCRIPTION OF THE PREFERRED EMBODIMENT

Figure 1:
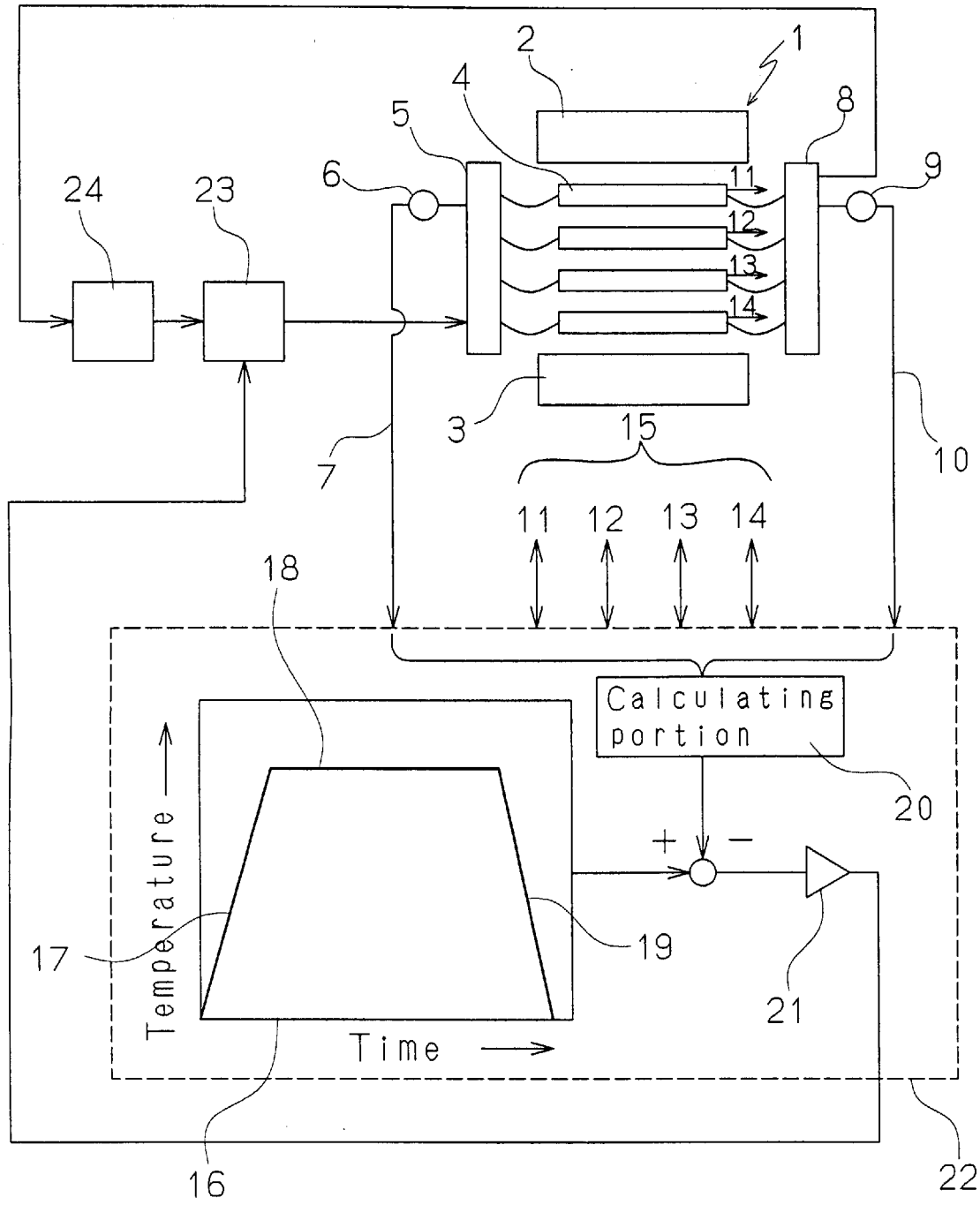
FIG. 1 is a block diagram showing the outline of a hot pressing apparatus and a control method for controlling the temperature of heating plates.

Embodiments of the present invention will be described in detail with reference to the drawings. FIG. 1 is a block diagram showing the outline of a hot pressing apparatus and a control method for controlling the temperature of the heating plates.

In the hot pressing of the present invention, sensors 6, 9 and 11 to 14 are respectively provided at the inlet manifold 5, the outlet manifold 8 and the heating plates 4 in the above described known hot pressing apparatus 1. The inlet manifold 5 and the outlet manifold 8 are columnar containers which are respectively connected to the opposite end faces of the plural heating plates 4 via heat-resistant flexible hoses. The inlet manifold 5 has an inlet to which a pipe extending from the control valve 23 is connected, and the temperature-controlled heating medium introduced through the inlet is uniformly distributed and supplied to a heating medium passage formed in each heating plate 4 via the plural hoses. The outlet manifold 8 has an outlet to which a pipe extending to the heating medium source 24 is connected, and the heating medium discharged from each heating plate 4 is collected in the outlet manifold 8 and is discharged through the outlet.

The sensors 6 and 9 are temperature or pressure detectors, and extend through wall surfaces of the inlet manifold 5 and the outlet manifold 8, at relatively high positions thereof, so as to detect an average temperature or pressure of the heating medium supplied to each heating plate 4. If the heating medium is hot oil or water, a temperature detector composed of a thermocouple or a temperature measuring resistor is used for each of the sensors 6 and 9. If the heating medium is vapor, a vapor pressure detector is used for each of the sensors 6 and 9, and signals from the detectors are input to a controller 22 and are converted into temperature signals corresponding to the vapor pressure. Thus, feedback signals for controlling the temperature of the heating plates can be obtained.

The sensors 11, 12, 13 and 14 are each composed of a thermocouple or the like, and are embedded in the side surfaces of the respective heating plates 4 to directly detect the temperature of the heating plates 4. Heating plate temperature signals 15 from the sensors 11, 12, 13 and 14 are input to the controller 22 and are averaged to obtain a single temperature value which is used as feedback signals for controlling the temperature of the heating plates. The sensors 11, 12, 13 and 14 are not necessarily provided for all the heating plates 4. If one or plural sensors can detect an average temperature of all the heating plates, some of the sensors can be omitted.

The controller 22 sets setting values and outputs calculated and amplified signals to actuators to control the operation and the pressing force of the hot pressing apparatus 1 and the temperature of the heating plates. The controller 22 is composed of a known microprocessor or the like. Numeral 16 designates a temperature-setting pattern to set the temperature of the heating plates in a series of processes for forming a workpiece. The pattern is displayed in a display portion such as a CRT or a liquid crystal display panel that is a man-machine interface for the controller 22. The temperature-setting pattern 16 is mainly composed of the temperature increasing step 17, the maintaining step 18 and the cooling step 19, and the temperature of the heating medium (heating plates 4) which is varied with the passage of time can be set in the form of a line graph. Temperature or pressure signals 7, 10 sent from sensors 6, 9 and the heating plate temperature signals 15 are input to the controller 22 and are converted into a temperature signal in a calculating portion 20. After that, a weighted average of the temperature signals based on a weighted temperature corresponding to the steps and the temperature-setting range shown in FIG. 2 is converted into a temperature value. Temperature-setting signals output according to the temperature-setting pattern 16 with passage of time is compared with the temperature value and is feedback-calculated based on the PID constant set in FIG. 2. After that, the current is amplified by an amplifier 21 to drive the control valve 23.

Similar to a diaphragm valve or a three-way valve, the control valve 23 adjusts an opening or a passage, and adjusts the pressure or the flow rate of the heating medium to be supplied to the heating plates 4 to control the temperature of the heating plates 4. The heating medium source 24 forms a temperature controller provided with a boiler or heater, a cooling device and a pump, and feeds the compressed heating medium to control the temperature of the heating plates 4 in cooperation with the control valve 23.

FIG. 2 shows an example of an indicator displayed in a display portion of the controller 22, in which the weight of the temperature and the PID constant of each sensor in a temperature controlling loop of the heating medium to control the temperature of the heating plates are set. The temperature-setting pattern is mainly divided into the temperature increasing step, the maintaining step and the cooling step, and each step is divided into three by a value that can arbitrarily set the temperature-setting range. Namely, the weight of temperature and the control constant can be set for each section of the nine-divided temperature-setting pattern.

The weight of temperature is set, by percent, so that the sum of the ratios of the temperature of the inlet manifold 5, the temperature of the heating plates 4 and the temperature of the outlet manifold 8, contributing to the feedback control is 100. Basically, the weight of the temperature of the inlet manifold 5 is made small and is about 10% except when the temperature is low in the cooling step. The weight of temperature of the heating plates 4 is increased from the temperature increasing step to the maintaining step or as the preset temperature value is increased. Particularly, the weight of temperature of the heating plates 4 is sometimes 100% when the temperature is low in the cooling step. The weight of temperature of the outlet manifold 8 has a tendency opposite to the weight of temperature of the heating plate, i.e., it is decreased from the temperature increasing step to the maintaining step or as the set value of temperature is increased. The temperature value is sometimes obtained by obtaining a weighted average of two temperatures other than the temperature of the inlet manifold 5 because the weight of temperature of the inlet manifold 5 is generally small as described above. A weighted average of at least two temperatures from among the weighed temperature of the inlet manifold 5, the weighed temperature of the heating plates 4 and the weighed temperature of the outlet manifold 8 is obtained in the calculating portion 20 to obtain a temperature value.

The control constant is composed of P (proportionality constant), I (integration constant) and D (differential constant). P is also referred to as a gain for the feedback control, and determines the width of proportional band by percent of a control range. Therefore, the gain is increased as the value of P is decreased. For I, a deviation between a preset value of the integration time set in seconds, and a measured value is integrated in the integration time to obtain an adjusted value. For D, a variation of a deviation between a preset value of the differential time set in seconds and a measured value is differentiated in the differential time to obtain an adjusted value. Generally, P is decreased as the preset temperature value is increased in the temperature increasing step and the maintaining step, but P is decreased as the preset temperature value is decreased in the cooling step. I and D may be substantially constant regardless of the sections of the temperature-setting pattern.

If the heating medium is vapor, a vapor pressure sensor is disposed at the inlet manifold 5. This is because it is difficult to carry out the control if the sensors were disposed at the outlet manifold 8 because a part of the vapor is condensed into water at the outlet manifold, or the sensor is apart from the control valve 23. The sensors 6 and 11 to 14 are used. Therefore, the weight of temperature in this case is set so that the sum of the vapor pressure (temperature) of the inlet manifold 5 and the temperature of the heating plates 4 becomes 100%. The temperature value can be obtained by obtaining the weighted average of these two temperatures.

In another embodiment, the effect of the present invention can be obtained by a simple method in which no complicated calculation such as a weighted average based on the weight of temperature shown in FIG. 2 is carried out. Namely, any two from among the temperature of the heating medium in the inlet manifold 5 that distributes and supplies the heating medium to each heating plate, the temperature of the heating medium in the outlet manifold 8 that collects the heating medium discharged from the heating plates 4, and the temperature of the heating plates 4, are detected. One of the two temperatures which have been set for each step of the temperature-setting pattern is selected, and the selected temperature value is feedback-controlled so as to be identical to the temperature-setting pattern. In this control, any two temperatures are selected from among temperatures of the heating medium in the inlet manifold 5, the heating medium of the outlet manifold 8 and the heating plates 4, in the temperature-setting pattern shown, for example, in FIG. 2. In this selection, if a weight of 0% is set for one temperature, then a weight of 100% is set for the other temperature, and vice versa. The same is true in each section of the temperature-setting pattern.

Namely, even if a general-purpose temperature controller is used without using a special controller that requires sophisticated software, when the heating medium is hot oil or water, the sensors are selected to carry out the control so as to perform a feedback-control only by the temperature of the outlet manifold 8 in, for example, the temperature increasing and maintaining steps, and only by the temperature of the heating plate 4 in the cooling step. Thus, good cooling characteristics closer to the temperature-setting pattern can be obtained than in a conventional feedback control which is carried out only by the temperature of the outlet manifold 8 for all the steps.

As described above, according to the present invention, an optimum sensor is selected, in view of weight, in each section of the temperature-setting pattern, and feedback-control is carried out based on the selected temperature value or the weighted average of the temperature. As a result, the temperature of the heating plates can be controlled without a large deviation from the temperature-setting pattern, and an overshoot or undershoot does not occur. Thus, the workpiece can be reliably formed. This significantly contributes to an improved yield and an increased productivity.

What is claimed is:

1. A temperature control method in hot pressing, comprising heating plates whose temperature is controlled by use of a heating medium; and a pressing device to press workpieces placed on the heating plates, wherein any two temperatures from among a temperature of the heating medium in an inlet manifold that distributes and supplies the heating medium to each heating plate, a temperature of the heating medium in an outlet manifold that collects the heating medium discharged from the heating plates and a temperature of the heating plates, are detected; the two temperatures are selected in accordance with a temperature-setting pattern; and feedback-control is carried out so that the selected temperature matches the temperature-setting pattern.

2. A temperature controlling method in hot pressing, comprising heating plates whose temperature is controlled by use of a heating medium; and a pressing device to press workpieces placed on the heating plates, wherein at least two temperatures from among a temperature of the heating medium in an inlet manifold that distributes and supplies the heating medium to each heating plate, a temperature of the heating medium in an outlet manifold that collects the heating medium discharged from the heating plate and a temperature of heating plates, are detected; and feedback-control is carried out so that a temperature value obtained by obtaining a weighted-average of the at least two temperatures based on preset weights matches the temperature-setting pattern.

3. A temperature controlling method in hot pressing, according to claim 2, wherein the weights of the temperature of the heating medium in the inlet manifold, the temperature of the heating medium in the outlet manifold and the temperature of the heating plates can be set at different values corresponding to process sections of the temperature-setting pattern of the heating plates.

4. A temperature controlling method in hot pressing, according to claim 3, wherein the weights of the temperature of the heating medium in the inlet manifold, the temperature of the heating medium in the outlet manifold and the temperature of the heating plates can be set at different values in accordance with a temperature-setting range set for each process section of the temperature-setting pattern of the heating plates.

5. A temperature controlling method in hot pressing, according to claim 4, wherein PID constants in the feedback-control can be set at different values in accordance with the temperature-setting range set for each process section of the temperature-setting pattern of the heating plates.

* * * * *